US007331335B2

(12) United States Patent
Okuda

(10) Patent No.: US 7,331,335 B2
(45) Date of Patent: Feb. 19, 2008

(54) FUEL VAPOR TREATMENT SYSTEM FOR INTERNAL COMBUSTION ENGINE

(75) Inventor: Yoshihiro Okuda, Kariya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/653,358

(22) Filed: Jan. 16, 2007

(65) Prior Publication Data

US 2007/0181103 A1 Aug. 9, 2007

(30) Foreign Application Priority Data

Feb. 7, 2006 (JP) ..... 2006-029968

(51) Int. Cl.
*F02M 33/02* (2006.01)
*F02M 33/04* (2006.01)

(52) U.S. Cl. ..... 123/520; 123/519

(58) Field of Classification Search ..... 123/520, 123/519, 518, 516, 521, 494; 73/119 A, 73/23.2

See application file for complete search history.

(56) References Cited

U.S. PATENT DOCUMENTS 6,971,375 B2 12/2005 Amano et al.
2006/0042605 A1 3/2006 Amano et al.
2006/0225714 A1* 10/2006 Kano et al. ..... 123/520
2007/0157908 A1* 7/2007 Kano et al. ..... 123/520

FOREIGN PATENT DOCUMENTS

JP 5-18326 1/1993

* cited by examiner

*Primary Examiner*—Mahmoud Gimie
(74) *Attorney, Agent, or Firm*—Nixon & Vanderhye P.C.

(57) ABSTRACT

A fuel vapor treatment system includes a three-position valve for switching between a first measuring state and a second measuring state, and a pressure sensor for measuring pressure produced by a restriction in a measurement line. In the first measuring state, air flows through the measurement line. In the second measuring state, air-fuel mixture flows through the measurement line. The behavior of change in a first pressure in the first measuring state and the behavior of change in a second pressure in the second measuring state are measured. When that the behaviors of change in the first and second pressures are substantially identical to each other, it is determined that an abnormality occurs in an operation of switching the three-position valve.

5 Claims, 9 Drawing Sheets

FUEL VAPOR TREATMENT SYSTEM FOR INTERNAL COMBUSTION ENGINE

CROSS-REFERENCE TO RELATED APPLICATION

This application is based on Japanese Patent Application No. 2006-29968 filed on Feb. 7, 2006, the disclosure of which is incorporated herein by reference.

FIELD OF THE INVENTION

The present invention relates to a fuel vapor treatment system for an internal combustion engine.

BACKGROUND OF THE INVENTION

A fuel vapor treatment system is used for preventing fuel vapor produced in a fuel tank from being dissipated into the atmosphere and introduces the fuel vapor in the fuel tank into a canister accommodating an adsorbent to adsorb the fuel vapor temporarily by the adsorbent. The fuel vapor adsorbed by the adsorbent is desorbed by negative pressure produced in an intake pike when an internal combustion engine is operated and is purged into the intake pipe of the internal combustion engine through a purge passage. When the fuel vapor is desorbed from the adsorbent in this manner, the adsorbing capacity of the adsorbent is recovered.

When the fuel vapor is purged, the flow rate of an air-fuel mixture containing the fuel vapor is adjusted by a purge control valve provided in the purge passage. However, to adjust the amount of fuel vapor actually purged into the intake pipe to a suitable air-fuel ratio by the purge control valve, it is important to measure the concentration of the fuel vapor in the air-fuel mixture flowing through the purge passage with high accuracy.

In the related art, for example, as disclosed in JP-5-18326A, mass flowmeters are set in the purge passage and in an atmosphere passage branched from the purge passage. The concentration of the fuel vapor in the air-fuel mixture supplied to the purge passage of the internal combustion engine from the purge passage is detected on the basis of the output values of the two mass flowmeters.

However, in this system, since the mass flowmeter is set in the purge passage, the concentration of the fuel vapor cannot be detected unless the air-fuel mixture containing the fuel vapor is purged and is flowed through the purge passage. For this reason, to reflect the detected concentration of the fuel vapor to an air-fuel ratio control, it is necessary to finish detecting the concentration of the fuel vapor before the purged fuel vapor reaches an injector. It is necessary to correct a command value of the amount of injection of fuel to be injected from the injector by the use of the concentration of the fuel vapor.

However, in the case that the volume of an intake pipe is small or the velocity of flow of intake air is fast, the time required for the purged fuel vapor to reach the injector is shorter than the time required to finish measuring the concentration of the fuel vapor. There are cases where it is not possible to reflect the measured concentration of the fuel vapor to the air-fuel ratio control from the start of purge. Thus, this results in limiting an engine structure such as the layout of piping and an operating range where purge is started.

In view of these points, the present applicant has invented and applied a system capable of measuring the concentration of fuel vapor contained in an air-fuel mixture irrespective of purging the air-fuel mixture containing the fuel vapor (refer to U.S. Pat. No. 6,971,375 B2). This system has a pump provided in a measurement passage having a restrictor and can produce a gas flow in the measurement passage and has a switching valve for switching gas flowing in this measurement passage to either air in the atmosphere or an air-fuel mixture containing fuel vapor. The system has a differential pressure sensor for measuring a differential pressure developed across the restrictor when a gas flow is produced in the measurement passage and measures a differential pressure when the gas flow is air and a differential pressure when the gas flow is an air-fuel mixture containing fuel vapor.

Here, as the concentration of fuel vapor contained in the air-fuel mixture becomes larger, the density of the air-fuel mixture becomes larger, so a differential pressure across the restrictor becomes larger. A differential pressure ratio between a differential pressure when the gas flow is air and a differential pressure when the gas flow is air-fuel mixture is nearly proportional to the concentration of fuel vapor. Thus, the concentration of fuel vapor can be found from the differential pressure ratio.

In the above-mentioned system, the operation of switching gas flowing through the measurement passage to air and air-fuel mixture by a switching valve is necessary for measuring the concentration of fuel vapor. For this reason, when the switching valve cannot perform the switching operation normally, it is important to detect an abnormality in the switching valve quickly.

SUMMARY OF THE INVENTION

The present invention has been made in view of the above-mentioned points. The object of the invention is to provide a fuel vapor treatment system of an internal combustion engine in which the abnormality can be detected with high accuracy when an abnormality occurs in an operation of switching between a first measuring state and a second measuring state. In the first measuring state, air flows through a measurement passage. In the second measuring state, air-fuel mixture containing fuel vapor flows through the measurement passage.

To achieve the above-mentioned object, a fuel vapor treatment system of an internal combustion engine includes a canister, concentration measuring means that measures a fuel vapor concentration in an air-fuel mixture, and flow rate control means that is provided in a purge passage. The flow rate control means controls a flow rate of the air-fuel mixture containing the fuel vapor purged into the intake pipe on the basis of the fuel vapor concentration.

In the concentration measuring means, a measurement passage is provided with a restrictor. A gas flow producing means produces a gas flow in the measurement passage. A pressure measuring means measures pressure produced by the restrictor when the gas flow producing means produces the gas flow. A measurement passage switching means switches the measurement passage between a first measuring state in which the measurement passage is opened to the atmosphere and a second measuring state in which the measurement passage is made to communicate with the canister. A fuel vapor concentration computing means computes concentration of the fuel vapor on the basis of a first pressure measured by the pressure measuring means in the first measuring state and a second pressure measured by the pressure measuring means in the second measuring state. A malfunction determining means compares behavior of change in the first pressure after starting to measure the first pressure in the first measuring state with behavior of change in the second pressure after starting to measure the second pressure in the second measuring state. It is determined that the measurement passage switching means has a malfunction when the behaviors of change in these first and second pressures are substantially identical to each other.

When the fuel vapor is hardly adsorbed by the adsorbent in the canister, even if the canister is made to communicate with the measurement passage, the gas flowing through the measurement passage hardly contains the fuel vapor. In this case, the convergence value of the second pressure measured as the second pressure becomes nearly equal to the convergence value of the first pressure. Thus, it is impossible to determine from the convergence values of the respective pressures whether or not the measurement passage switching means performs a switching operation normally.

Here, since the measurement passage is made to communicate with the canister in the second measuring state, this canister also constructs a portion of measurement passage. For this reason, flowing resistance to the gas flow in the measurement passage in the second measuring state becomes larger than flowing resistance in the first measuring state. Thus, the fuel vapor is hardly adsorbed by the adsorbent in the canister, so even when the convergence values of the first and second pressures become nearly equal to each other, the second pressure is decreased to its convergence value with delay in time as compared with the first pressure.

Therefore, as described above, it is possible to determine whether the switching operation by the measurement passage switching means is abnormal with high accuracy on the basis of whether the behaviors of change in the first and second pressures are substantially identical to each other.

BRIEF DESCRIPTION OF THE DRAWINGS

Other objects, feature and advantages of the present invention will become more apparent from the following detailed description made with reference to the accompanying drawings, in which like parts are designated by like reference numbers and in which.

DETAILED DESCRIPTION OF THE PREFERRED EMBODIMENTS

Figure 1:
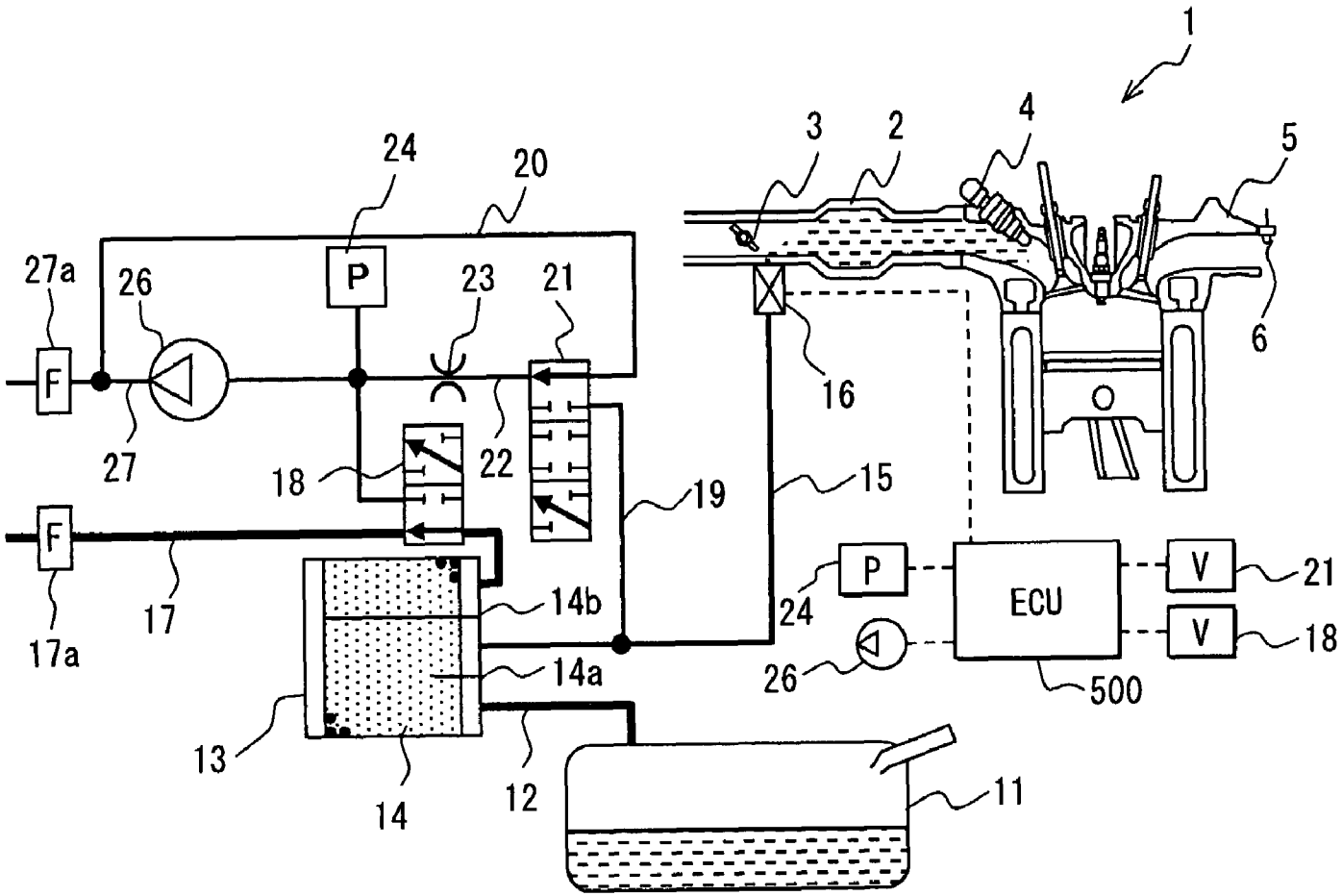
FIG. 1 is a schematic view showing a fuel vapor treatment system according to an embodiment of the invention.

Hereinafter, the preferred embodiment of the invention will be described. FIG. 1 is a construction diagram to show the construction of a fuel vapor treatment system according to an embodiment of the invention. The fuel vapor treatment system is applied to the engine of an automobile. A fuel tank 11 of an engine 1 of an internal combustion engine is connected to a canister 13 via an evaporation line 12 of a vapor introduction passage. The canister 13 is packed with an adsorbent 14, and fuel vapor produced in the fuel tank 11 is temporarily adsorbed by the adsorbent 14. The canister 13 is connected to an intake pipe 2 of the engine 1 via a purge line 15. The purge line 15 is provided with a purge valve 16 and when the purge valve 16 is opened, the canister 13 is made to communicate with the intake pipe 2.

A partition plate 14*a* is provided in the canister 13 between a position where the canister 13 is connected to the evaporation line 12 and a position where the canister 13 is connected to the purge line 15. The partition plate 14*a* prevents the fuel vapor from being purged without being adsorbed by the adsorbent 14. Moreover, the canister 13 has an atmosphere line 17 also connected thereto. A partition plate 14*b* which is nearly as deep as the packing depth of the adsorbent 14 is provided in the canister 13 between a position where the canister 13 is connected to the atmosphere line 17 and a position where the canister 13 is connected to the purge line 15. The partition plates 14*a*, 14*b* prevent the fuel vapor introduced from the evaporation line 12 from being purged from the atmosphere line 17 without being adsorbed.

The purge valve 16 is a solenoid valve. An electronic control unit 500 adjusts the opening degree of the purge valve 16, and controls the respective parts of the engine 1. The flow rate of the air-fuel mixture containing the fuel vapor flowing through the purge line 15 is controlled by the opening degree of the purge valve 16. The air-fuel mixture is purged into the intake pipe 2 by negative pressure in the intake pipe 2, produced by a throttle valve 3, and is combusted with fuel injected from the injector 4 (hereinafter, air-fuel mixture containing the purged fuel vapor is referred to as "purge gas").

The atmosphere line 17 opened to the atmosphere via a filter 17*a* is connected to the canister 13. This atmosphere line 17 is provided with a switching valve 18 for making the canister 13 communicate with the atmosphere line 17 or the suction port of a pump 26. When the switching valve 18 is not driven by the electronic control unit, the switching valve 18 is positioned at a first position where the canister 13 is made to communicate with the atmosphere line 17. When the switching valve 18 is driven by the electronic control unit, the switching valve 18 is switched to a second position where the canister 13 is made to communicate with the suction port of the pump 26. It is checked whether an opening to leak the fuel vapor is formed in the purge line 15 and the like when the switching valve 18 is switched to the second position.

At the time of this leak check, first, the switching valve 18 is switched to the first position. When an air flow passes through a restriction 23, pressure is measured. This measured pressure is set as a reference pressure. Then, the switching valve 18 is switched to the second position and pressure is measured. The measured pressure is compared with the reference pressure. At this time, when the measured pressure is not lower than the reference pressure, it can be presumed that an opening larger than the restriction 23 will be formed in the purge line 15 and the like and hence it is determined that a leak occurs.

A branch line 19 branched from the purge line 15 is connected to one input port of a three-position valve 21. Moreover, an air supply line 20 branched from the discharge line 27 of a pump 26, opened to the atmosphere via a filter 27*a*, is connected to the other input port of the three-position valve 21. A measurement line 22 is connected to the output port of the three-position valve 21. The three-position valve 21 is switched by the above-mentioned electronic control unit to any one of a first position, a second position, and a third position. In the first position the air supply line 20 is connected to the measurement line 22. In the second position, both of the air supply line 20 and the branch line 19 are prevented from communicating with the measurement line 22. In the third position, the branch line 19 is connected to the measurement line 22. Here, the three-position valve 21 is constructed so as to be set at the first position at the time of non-operation.

The measurement line 22 is provided with the restriction 23 and the pump 26. The pump 26 is an electrically operated pump. When the pump 26 is operated, the pump 26 generates a gas flow in the measurement line 22 from the restriction 23 to the suction port of the pump 26. The driving or stopping of the pump 26 and the number of revolutions of the pump 26 are controlled by the electronic control unit. When the electronic control unit drives the pump 26, the electronic control unit controls the pump 26 so as to keep the number of revolutions constant at a previously set value.

Thus, when the electronic control unit drives the pump 26 in a state in which the three-position valve 21 is set at the first position with the switching valve 18 set at the first position, there is brought about "a first measuring state" where air flows through the measurement line 22. Moreover, when the electronic control unit drives the pump 26 in a state in which the three-position valve 21 is set at the third position, there is brought about "a second measuring state" where an air-fuel mixture containing the fuel vapor supplied via the atmosphere line 17, the canister 13, a portion of the purge line 15 to the branch line 19, and the branch line 19 flows through the measurement line 22.

Moreover, a pressure sensor 24 for measuring pressure (negative pressure) produced by the restriction 23 when air or the air-fuel mixture flows is connected to the downstream side of the restriction 23, that is, a portion between the restriction 23 and the pump 26 of the measurement line 22. The pressure measured by the pressure sensor 24 is outputted to the electronic control unit.

The electronic control unit controls the degree of opening of a throttle valve 3 provided in the intake pipe 2 and for adjusting the amount of intake air and the amount of injection of fuel from the injector 4 on the basis of detection values detected by various kinds of sensors. For example, the electronic control unit controls the amount of injection of fuel and the opening degree of the throttle valve on the basis of the amount of intake air detected by an air flow sensor provided in the intake pipe 2, an intake air pressure detected by an intake air pressure sensor, an air-fuel ratio detected by an air-fuel ratio sensor 6 provided in an exhaust pipe 5, an ignition signal, the number of revolutions of the engine, an engine cooling water temperature, an accelerator position, and the like.

The electronic control unit performs not only the above-mentioned control but also purge control of treating the fuel vapor. This purge control will be described on the basis of a flow chart of the purge control shown in FIG. 2. Here, the purge control shown in this flow chart is performed when the engine 1 starts to operate.

First, in Step S101, it is determined whether a concentration detection condition (CDC) is established. The concentration detection condition (CDC) is set in such a way that when state amounts showing an operating state such as an engine cooling water temperature, an oil temperature, and the number of revolutions of the engine are within specified ranges and before a purge condition for allowing fuel vapor to be purged, the concentration detection condition is satisfied.

The purge condition is set in such a way that, for example, when the engine cooling water temperature becomes not less than a specified value T1 and hence warming-up the engine is determined to be finished, the purge condition is satisfied. Thus, because the concentration detection condition needs to be satisfied in the process of warming up the engine, the concentration detection condition is set in such a way that, for example, when the cooling water temperature is not less than a specified value T2 set lower than the specified value T1, the concentration detection condition is satisfied. Moreover, the concentration detection condition is set in such a way that the concentration detection condition is satisfied through a period of time during which the engine is being operated and which purging the fuel vapor is stopped (mainly in the process of deceleration). In this regard, when this fuel vapor treatment system is applied to a hybrid vehicle having an internal combustion engine and an electrically operated motor as driving sources, the concentration detection condition is set in such a way that also when the engine is stopped and the vehicle is driven by the motor, the concentration detection condition is satisfied.

Figure 2:
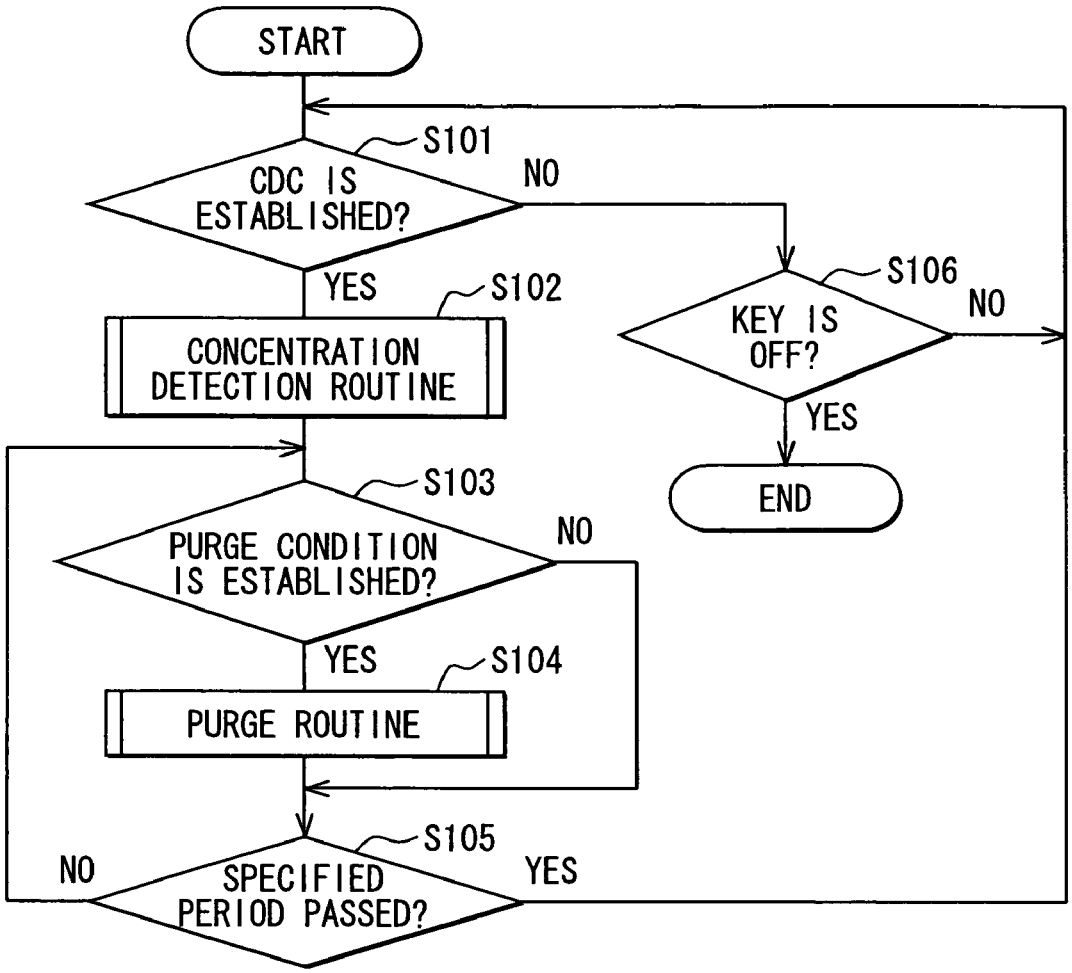
FIG. 2 is a flow chart of purge control.

When it is determined in Step S101 that the CDC is established, the routine proceeds to Step S102 where a concentration detection routine to be described later is executed. In contrast, when it is determined that the concentration detection condition is not satisfied, the routine proceeds to Step S106. It is determined in Step S106 whether an ignition key is turned off. When it is determined in the processing of Step S106 that the ignition key is not turned off, the routine returns to the Step S101. In contrast, when it is determined that the ignition key is turned off, processing by the flow chart shown in FIG. 2 is finished.

Figure 3:
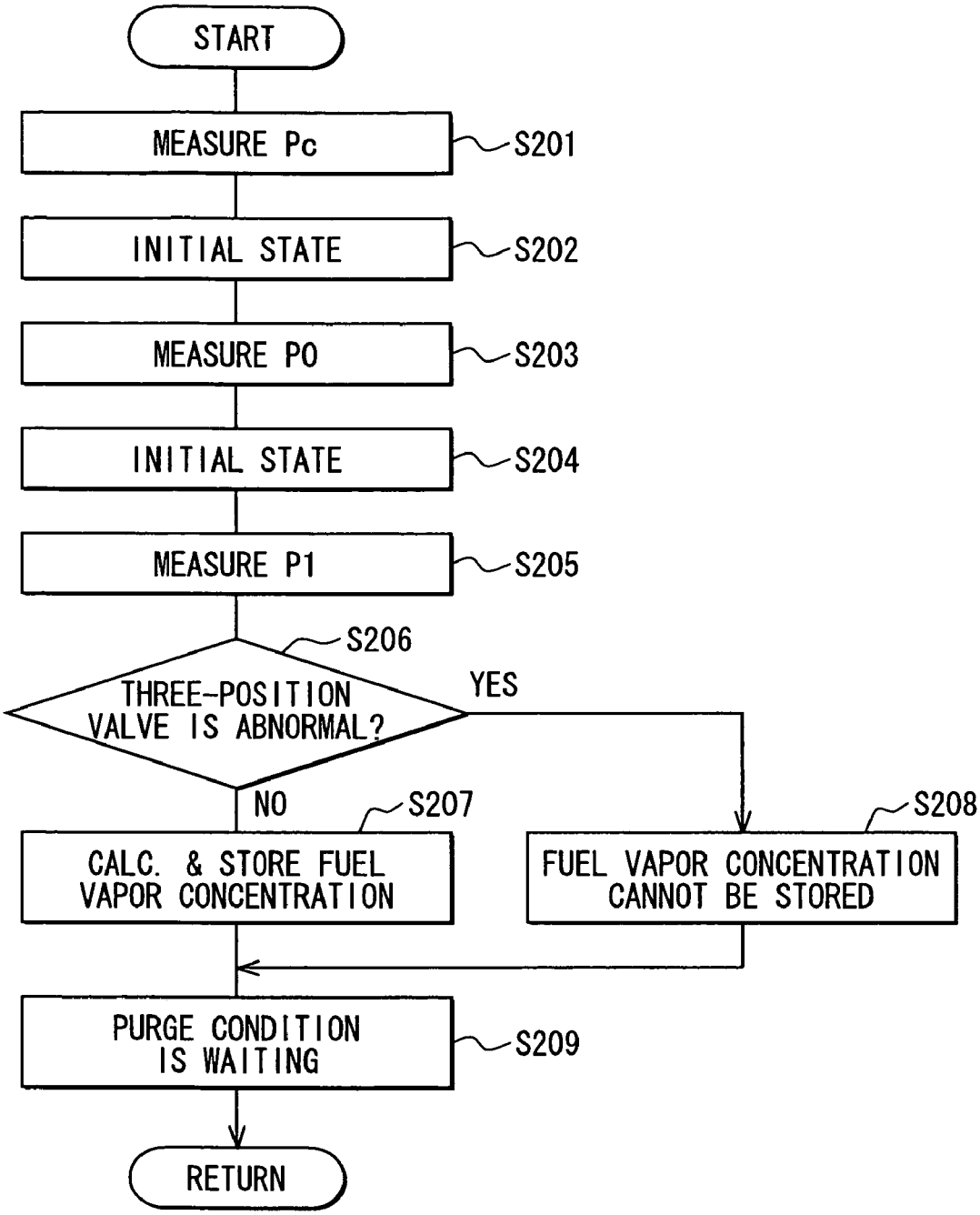
FIG. 3 is a flow chart of a concentration detection routine.
Figure 4:
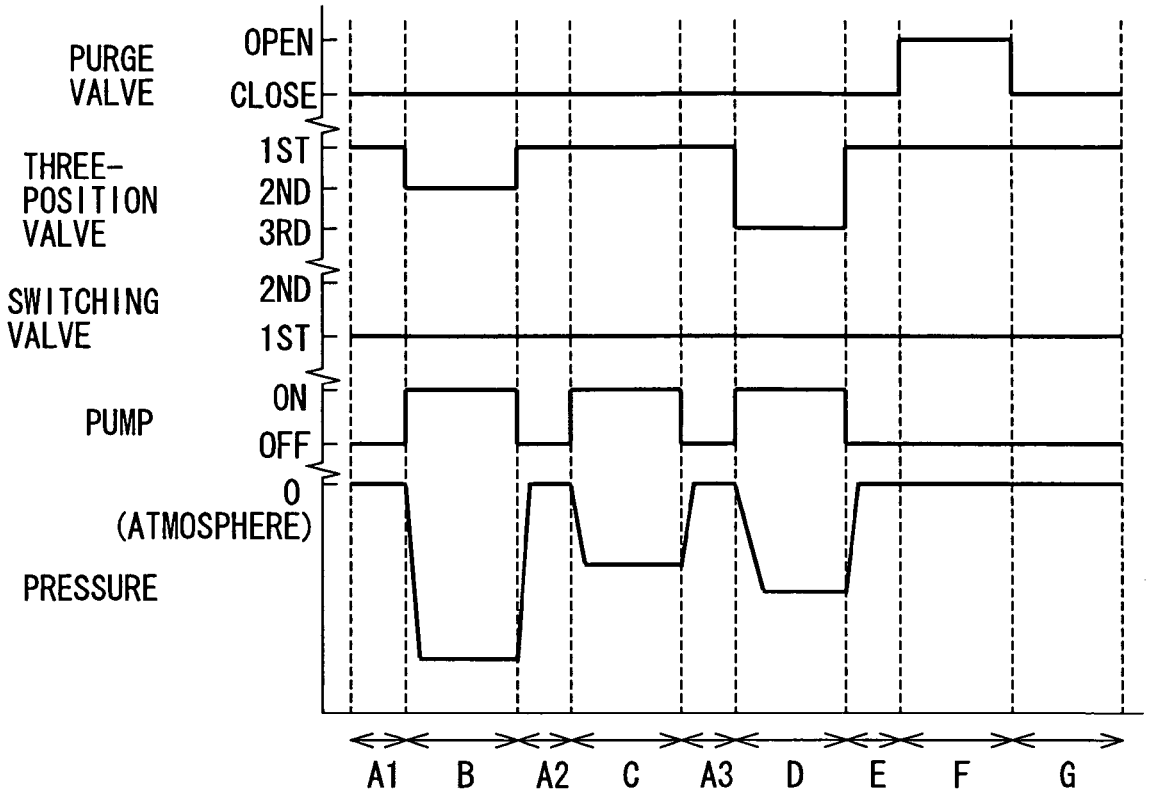
FIG. 4 is an operating waveform diagram to show the operating states of the respective parts of the fuel vapor treatment system.

Here, the concentration detection routine of Step S102 will be described in detail on the basis of a flow chart shown in FIG. 3 and an operating waveform diagram shown in FIG. 4. FIG. 4 shows the operating states of the respective parts. Here, the initial states of the respective parts before executing the concentration detection routine correspond to a period A1 in FIG. 4. In this period A1, the purge valve 16 is closed, and the switching valve 18 is set at the first position where the canister 13 is made to communicate with the atmosphere line 17, and the three-position valve 21 is set at the first position where the air supply line 20 is connected to the measurement line 22. For this reason, in the initial state, pressure detected by the pressure sensor 24 becomes nearly equal to the atmospheric pressure.

Figure 5:
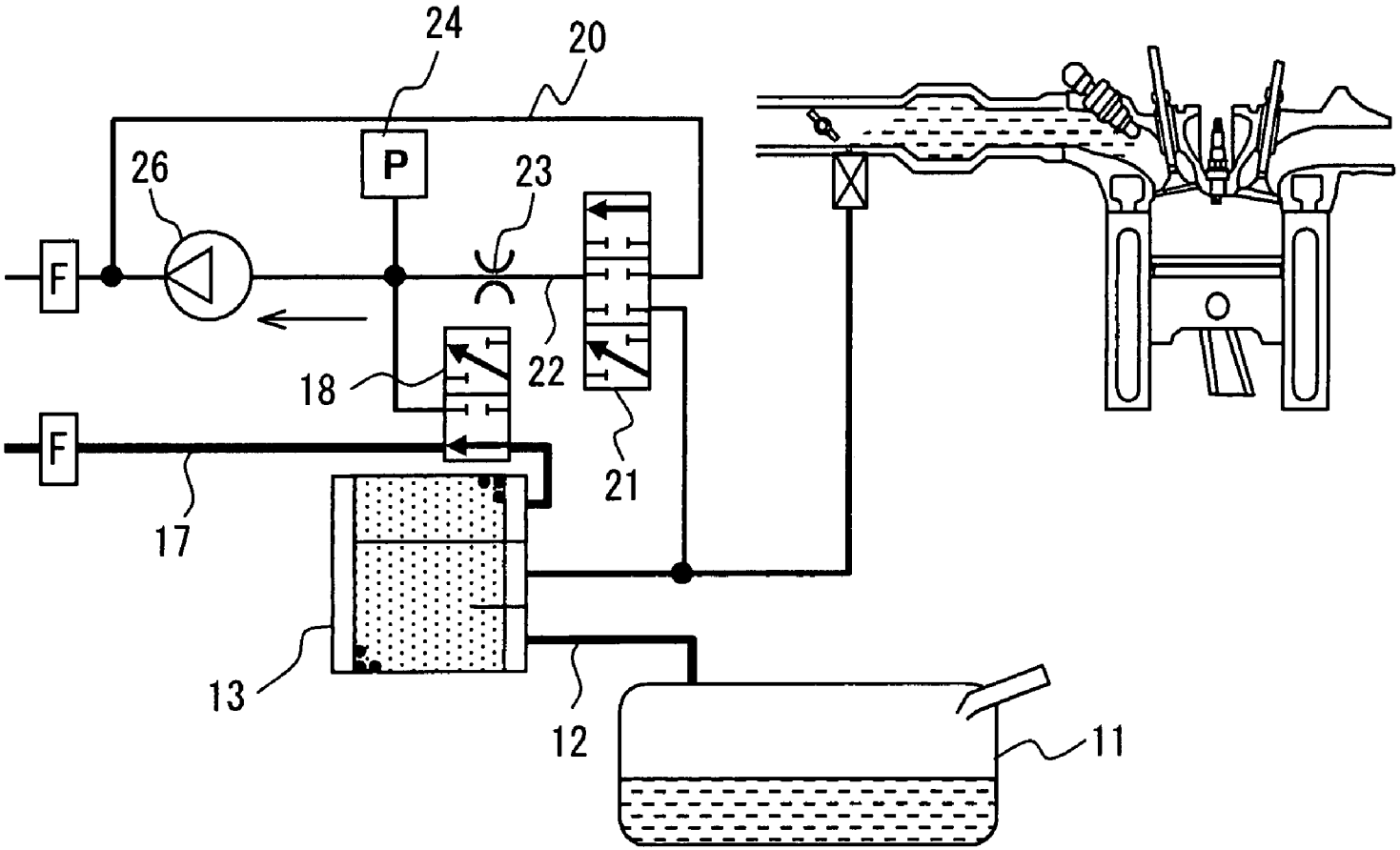
FIG. 5 is a diagram to show the operating states of the respective parts of the fuel vapor treatment system when a shutoff pressure Pc is measured.

First, in Step S201, a shutoff pressure Pc is measured. This shutoff pressure Pc is measured during a period B in the operating waveform diagram shown in FIG. 4 and is performed by switching the three-position valve 21 to the second position to bring the suction side of the pump 26 to a closed state and then by driving the pump 26. In this case, as shown in FIG. 5, air to be sucked by the pump 26 exists only in a connection line to the measurement line 22 and the switching valve 18. Thus, when this shutoff pressure Pc is measured, pressure detected by the pressure sensor 24 is decreased quickly.

It is determined whether the measured shutoff pressure Pc becomes lower than a previously set determination value. Based on this result, it is determined whether abnormal operation does not occur in the respective parts. That is, when the measured shutoff pressure Pc becomes lower than the determination value, it is assumed that the respective parts operate normally. However, when the shutoff pressure Pc does not become lower than the determination value, it is assumed that abnormalities such as reduction in power of the pump 26 or faulty switching operation and defective leak of the switching valve 18 and the three-position valve 21 occur.

The shutoff pressure Pc is used for determining whether pressure P0 by an air flow and pressure P1 by an air-fuel mixture flow are normally measured.

Next, in Step S202, the states of the respective parts is returned to the initial states before the shutoff pressure Pc being measured. The processing of returning the states to the initial states is performed during a period A2 in the operating waveform diagram in FIG. 4. The pump 26 is stopped while switching the three-position valve 21 to the first position. The pressure of the measurement line 22 is returned to the atmospheric pressure by the processing of returning the states to the initial states.

Figure 6:
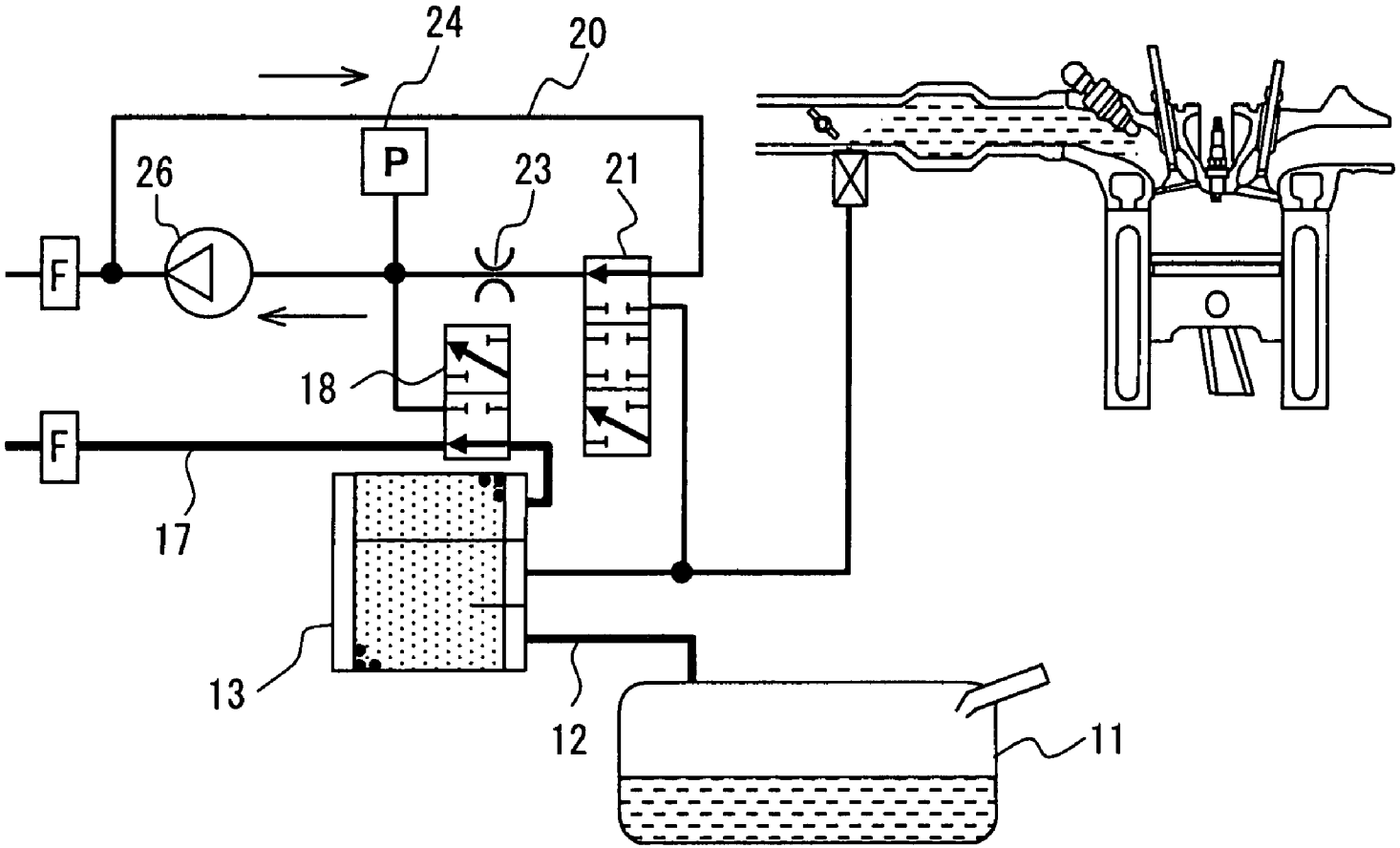
FIG. 6 is a diagram to show the operating states of the respective parts of the fuel vapor treatment system when a pressure P0 by an air flow is measured.

In Step S203, the pressure P0 is measured by the pressure sensor 24 in a state in which air is flowing through the measurement line 22, which corresponds to "a first measuring state." The measurement of the pressure P0 by the air flow is performed during a period C in FIG. 4 and is performed by driving the pump 26 with the three-position valve 21 held at the first position. In this case, as shown in FIG. 6, air is supplied to the measurement line 22 through the air supply line 21, so the pressure sensor 24 detects pressure (negative pressure) produced by the restriction 23 when air flows through the measurement line 22. At this time, the pressure sensor 24 detects pressure on the downstream side of the restriction 23 repeatedly at intervals, for example, a specified time period after the pump 26 is driven. With this, it is possible to measure not only the convergence value of the pressure P0 of the air flow in a steady state in which the air flow flows at a speed according to the specified number of revolutions of the pump 26 but also the behavior of pressure change to the convergence value.

Also in the measurement processing of the pressure P0, it is determined whether the respective parts operate normally on the basis of the measured pressure P0. Specifically, a pressure range is previously determined according to the diameter of the restriction 23 and the capacity of the pump 26, and whether or not the respective parts operate normally when the pressure P0 is measured is determined according to whether or not the convergence value of the measured pressure P0 is within the pressure range. For example, when the convergence value of the measured pressure P0 is not within the pressure range and the difference between the convergence value of the measured pressure P0 and the above-mentioned shutoff pressure Pc is a specified value or less, it is assumed that the three-position valve 21 causes a switching failure.

Next, in Step S204, just as in Step S202, the states of the respective parts is returned to their initial states. This processing for returning to the initial states is performed during a period A3 in FIG. 4. The pressure of the measurement line 22 is returned again to the atmospheric pressure.

Figure 7:
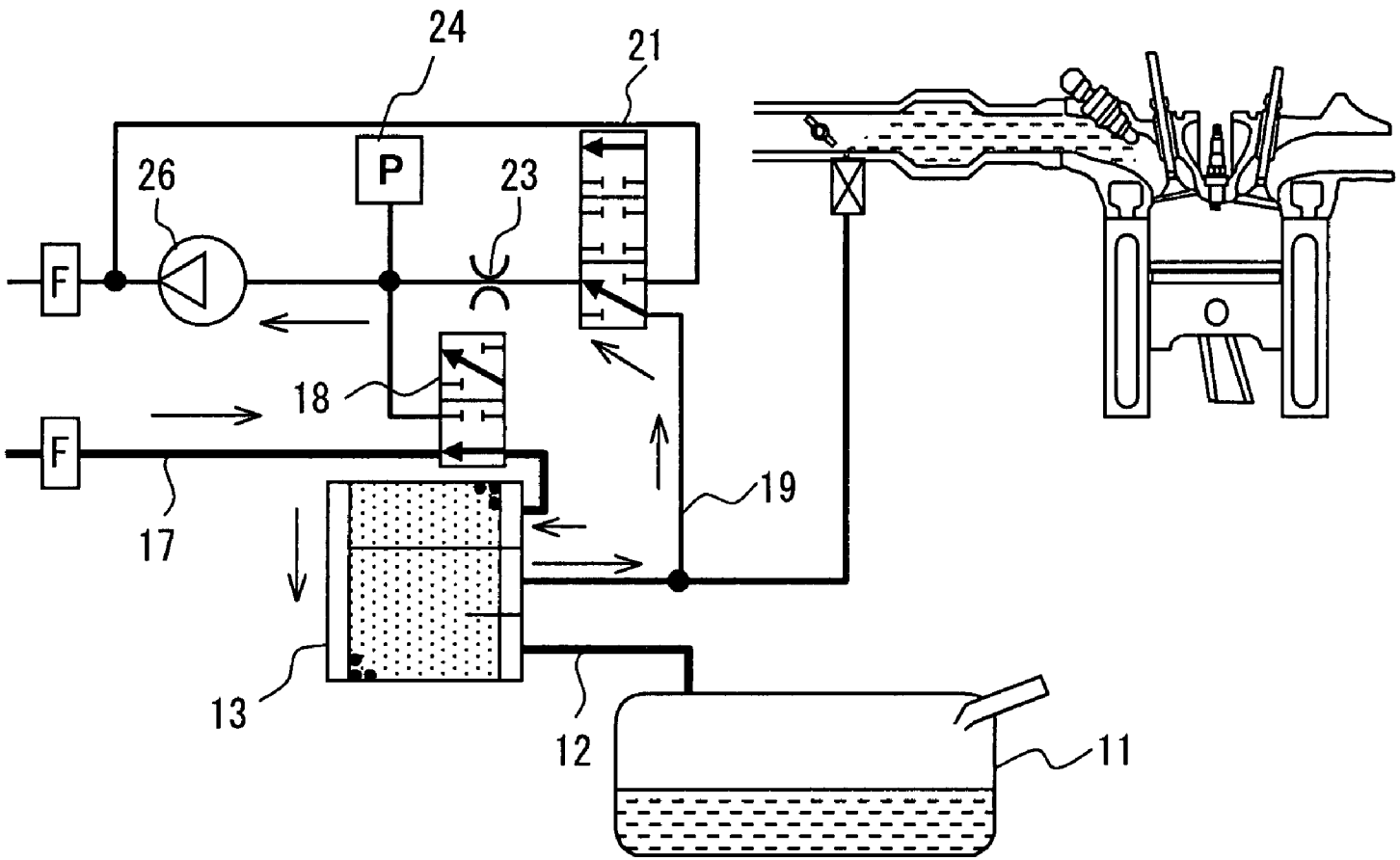
FIG. 7 is a diagram to show the operating states of the respective parts of the fuel vapor treatment system when a pressure P1 by an air-fuel mixture flow is measured.

In Step S205, the pressure P1 is measured in a state in which the air-fuel mixture containing the fuel vapor is flowed through the measurement line 22, which corresponds to a second measuring state. The measurement of the pressure P1 by the air-fuel mixture flow is performed during a period D in FIG. 4 and is performed by driving the pump 26 while switching the three-position valve 21 to the third position. In this case, the air-fuel mixture containing the fuel vapor supplied via the atmosphere line 17, the canister 13, a portion of the purge line 15 to the branch line 19, and the branch line 19 is supplied to the measurement line 22. That is, as shown in FIG. 7, air introduced from the atmosphere line 17 is flowed into the canister 13, thereby being brought to an air-fuel mixture of the fuel vapor and the air, and then is supplied to the measurement line 22 via a portion of the purge line 15 and the branch line 19. Thus, at the time of measuring pressure P1 by the air-fuel mixture flow, the pressure sensor 24 detects pressure (negative pressure) produced by the restriction 23 when the air-fuel mixture containing the fuel vapor flows through the measurement line 22.

At this time, just as in the case of measuring pressure P0, the pressure sensor 24 detects pressure on the downstream side of the restriction 23 repeatedly at intervals, for example, a specified time period after the pump 26 is driven. With this, it is possible to measure not only the convergence value of the pressure P1 by the air-fuel mixture flow but also the behavior of pressure change to the convergence value.

Moreover, also in the measurement processing of the pressure P1 by the air-fuel mixture flow, it is determined on the basis of the measured pressure P1 whether the respective parts can be assumed to operate normally. Specifically, a limit value on a low pressure side is determined on the basis of the shutoff pressure Pc, and a limit value on a high pressure side is determined on the basis of the convergence value of the pressure P0 by the air flow. And it is determined whether the respective parts operate normally when the pressure P1 is measured according to whether the convergence value of the measured pressure P1 is within a range determined by both of the limit values. Here, it is because pressure is not usually reduced to a value lower than the shutoff pressure Pc that the limit value on a lower pressure side is determined on the basis of the shutoff pressure Pc. When the air-fuel mixture flow contains the fuel vapor, the density of the air-fuel mixture becomes high and cannot readily flow through the restriction 23, so the convergence value of the pressure P1 by the air-fuel mixture flow becomes not larger than the convergence value of the pressure P0 by the air flow.

However, when the air-fuel mixture hardly contains the fuel vapor, the convergence value of the pressure P1 by the air-fuel mixture flow is nearly equal to the pressure P0. Thus, it is not possible to determine only from the convergence values of the respective pressures P0, P1 whether the respective parts are abnormal, in particular, the three-position valve 21 is switched normally from the first position to the third position.

For this reason, in this embodiment, it is determined whether the behavior of pressure change to the pressure P0 is substantially identical to the behavior of pressure change to the pressure P1, and it is determined by the use of also this determination result whether the three-position valve 21 is switched normally from the first position to the third position.

At the time of measuring the pressure P0, air flows through the air supply line 20 and the measurement line 22 and nothing other than the restriction 23 disturbs the air flow in the respective lines 20, 22. Moreover, the total length of the air supply line 20 and the measurement line 22 is set shorter than the length of a line when the pressure P1 by the air-fuel mixture flow is measured. Thus, the resistance of a passage when the air flow flows becomes relatively small and the pressure P0 is decreased quickly to its convergence value.

In contrast, at the time of measuring the pressure P1, the air-fuel mixture is supplied to the measurement line 22 via the atmosphere line 17, the canister 13, the portion of the purge line 15, and the branch line 19. Hence, the length of a line for flowing the air-fuel mixture becomes long and the canister exists in the line, so the resistance of the line for flowing the air-fuel mixture becomes larger than the resistance of a passage when the pressure P0 is measured.

Figure 8:
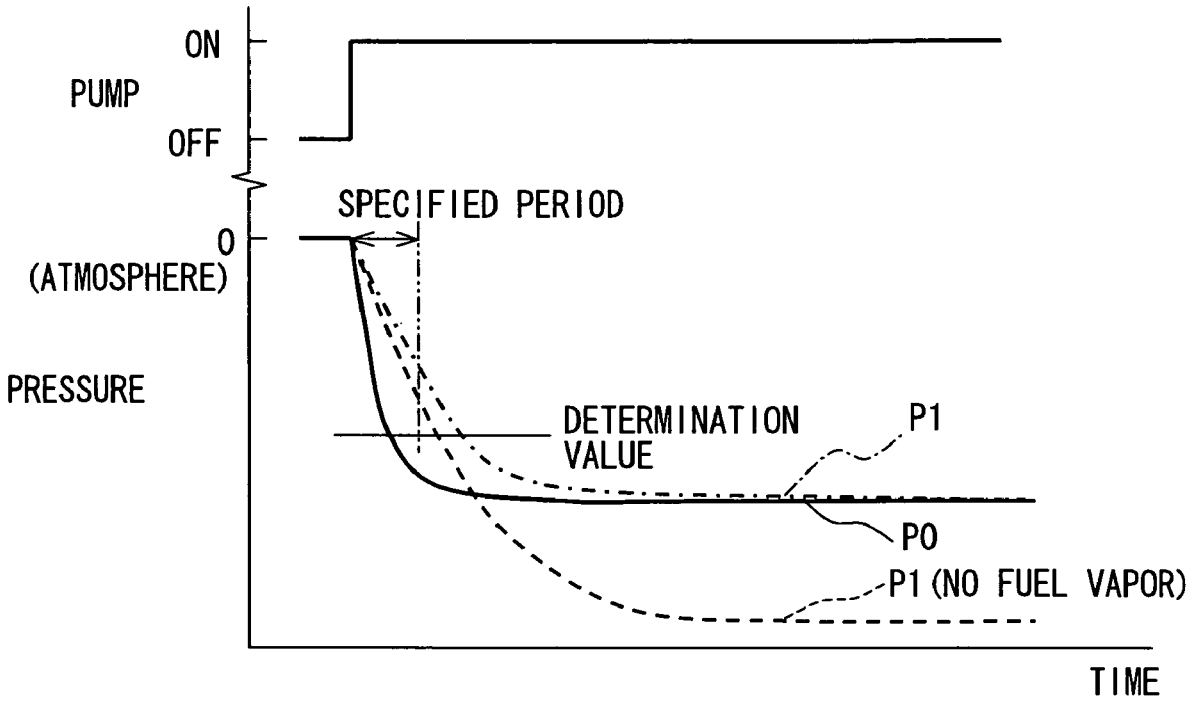
FIG. 8 is a diagram to show a method for determining with reference to the convergence value of the pressure P0 by the air flow whether the behavior of change in the pressure P1 by the air-fuel mixture flow is substantially identical to the behavior of change in the pressure P0 by the air flow.

As a result, because the fuel vapor is hardly adsorbed by the adsorbent 14 of the canister 13, even when the convergence value of the pressure P1 is nearly equal to the convergence value of the pressure P0, as shown in FIG. 8, the pressure P1 is decreased to its convergence value with delay in time as compared with the pressure P0. Thus, it can be determined whether the three-position valve 21 is switched normally from the first position to the third position with high accuracy on the basis of the behavior of pressure change to the convergence value of the pressure P0 and the behavior of pressure change to the convergence value of the pressure P1.

Specifically, as shown in FIG. 8, a pressure determination value larger than the convergence value of the earlier measured pressure P0 is determined on the basis of the convergence value. Then, when the pressure P1 becomes lower than the pressure determination value within a specified time period, it is determined that the behavior of change in the pressure P1 is determined to be substantially identical to the behavior of change in the pressure P0. Conversely, when the pressure P1 by the air-fuel mixture flow does not become the pressure determination value within the specified time period, it is determined that the behavior of change in the pressure P1 is different from the behavior of change in the pressure P0. With this, it is accurately determined whether the behavior of change in the pressure P0 is substantially identical to the behavior of change in the pressure P1 with reference to the convergence value of the actually measured pressure P0.

In the determination processing in Step S206, it is determined whether abnormal operations of the respective parts, including the abnormal switching operation of the three-position valve 21, occur in the determination processing in Steps S201, S203, and S205. When it is not determined that an abnormal operation occurs, the routine proceeds to Step S207 where a fuel vapor concentration is computed on the basis of the convergence values of the pressures P0 and P1 and is stored for use in the purge control. Here, the fuel vapor concentration can be found by multiplying the pressure ratio between the respective pressures P0 and P1 by a specified coefficient.

In contrast, when it is determined in the determination processing in Step S206 that an abnormal operation of the respective parts occurs, there is a high possibility that a fuel vapor concentration cannot be computed correctly on the basis of the pressures P0, P1 measured in the first and second measuring states, so the routine proceeds to Step S208 where it is stored that the fuel vapor concentration cannot be computed.

In the next Step S209, the states of the respective parts are brought to a state in which the purge condition is waiting to be satisfied. This processing is performed during a period E in FIG. 4 and is performed by stopping driving the pump 26 while switching the three-position valve 21 to the first position. The state in which the purge condition is waiting to be satisfied is identical to the initial state.

When the fuel vapor concentration contained by the air-fuel mixture is detected by the concentration detection routine of Step S102 in this manner, it is determined in Step S103 whether the purge condition is established. The purge condition is determined on the basis of the operating states such as engine cooling water temperature, oil temperature, and the number of revolutions of engine, just as in the general fuel vapor treatment system. When it is determined in this Step S103 that the purge condition is satisfied, the routine proceeds to Step S104 where the purge routine is executed.

The purge routine detects the operating state of the engine and computes the flow rate of purged fuel vapor on the basis of the detected operating state of the engine. Specifically, the flow rate of purged fuel vapor is computed on the basis of the amount of injection of the fuel required under the operating state of the engine such as the present opening degree of the throttle, and the lower limit value of the amount of injection of the fuel to be controlled by the injector. The opening degree of the purge valve 16 to realize this flow rate of purged fuel vapor is computed on the basis of the fuel vapor concentration. The purge valve 16 is opened until the purge stop condition is satisfied.

Figure 9:
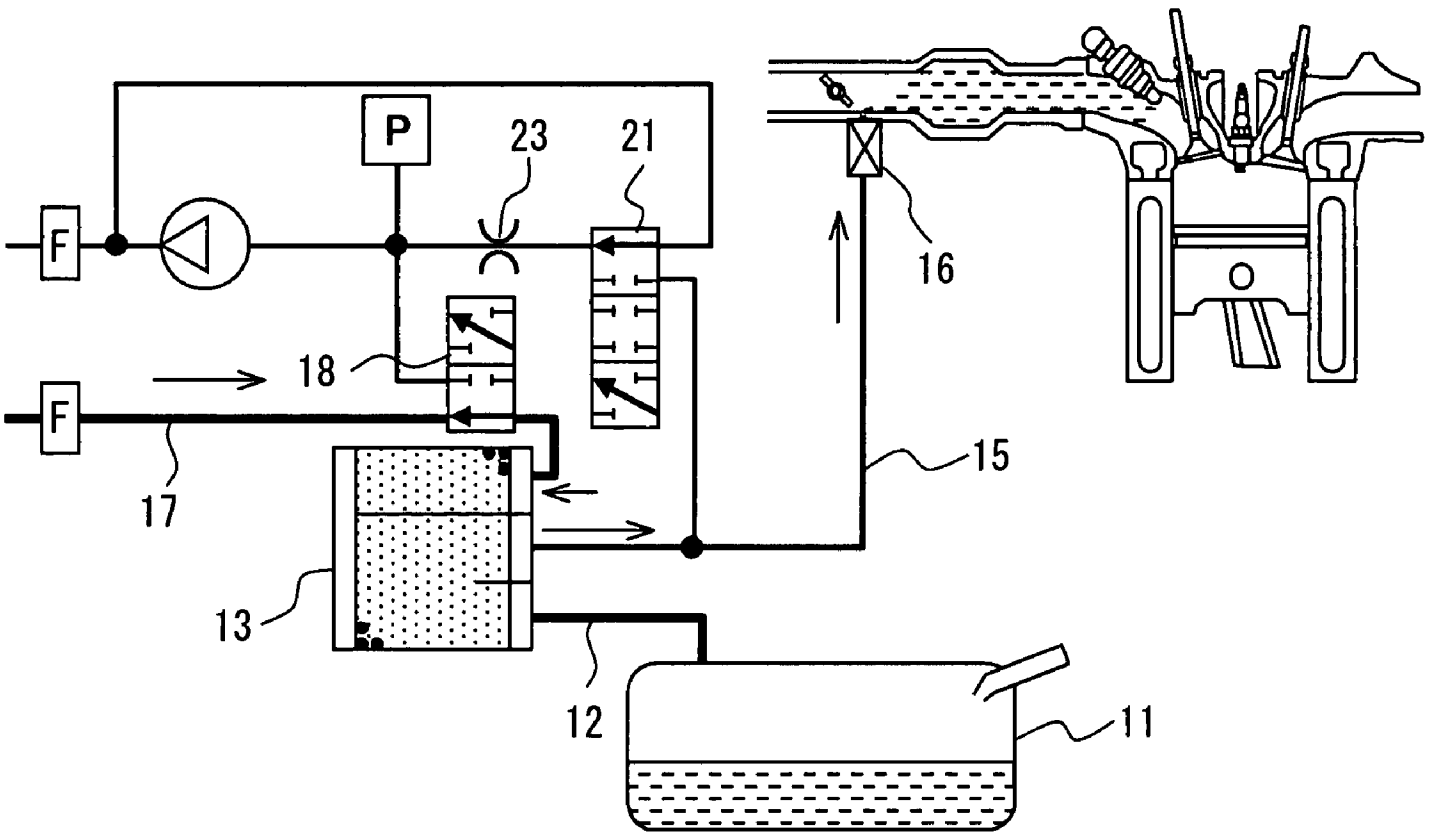
FIG. 9 is a diagram to show the operating states of the respective parts of the fuel vapor treatment system in a period of purging.

A purge period by this purge routine corresponds to a period F in FIG. 4. That is, in the purge period, as shown in FIG. 9, the purge valve 16 is opened with the switching valve 18 and the three-position valve 21 held at the first positions. With this, an air-fuel mixture flow is produced in a passage including the atmosphere line 17, the canister 13, and the purge line 15 by negative pressure in the intake pipe 2 of the engine 1. In other words, the atmosphere introduced from the atmosphere line 17 is mixed with the fuel vapor desorbed from the canister 13 to form the air-fuel mixture and the air-fuel mixture is purged into the intake pipe 2 of the engine 1. With this, the adsorbing capacity of the canister 13 is recovered. When the purge period F is finished, as shown by a period G in FIG. 9, the purge valve 16 is closed and the fuel vapor treatment system is returned to the initial state.

When the fuel vapor concentration cannot be computed in the concentration detection routine, the purge processing is stopped, or irregular purge processing such as limiting the purge condition or purging a small amount of fuel vapor is performed.

In contrast, when it is determined that the purge condition is not satisfied, it is determined in Step S105 whether a specified time period passes from the time when fuel vapor concentration is detected by executing the concentration detection routine. When it is determined that the specified time period does not pass, the routine returns to Step S103. When it is determined that the specified period of time passes from the time when fuel vapor concentration is detected, the routine returns to Step S101 and the processing of detecting the fuel vapor concentration is performed again and the fuel vapor concentration is updated to the newest value.

The preferred embodiment of the invention has been described. However, the invention is not limited to the above-described embodiment but may be variously modified within a range not departing from the scope and spirit of the invention.

For example, in the above-mentioned embodiment, the pressure determination value is set on the basis of the convergence value of the pressure P0. It is determined whether the pressure P1 becomes lower than the pressure determination value within a specified time period. Then, it is determined that the behavior of change in the pressure P1 is substantially identical to the behavior of change in the pressure P0. However, it is also possible to determine by the other method.

For example, an integrated values are computed within a specified period of time after the start of measurement with reference to the atmospheric pressure by the respective pressure change curves. When the difference between the integrated values is within a specified range, the behaviors of change in both pressures may be determined to be substantially identical to each other. Alternatively, gradients of the pressure change curves of both pressures are computed by differential computation. When the difference between the gradients is within a specified range, the behaviors of change in both pressures may be determined to be substantially identical to each other. Alternatively, locus lengths within a specified time period after the start of measurement are computed. When the difference between the locus lengths is within a specified range, the behaviors of change in both pressures may be determined to be substantially identical to each other.

Moreover, while only pressure downstream of the restriction 23 is detected in the above-mentioned embodiment, the pressure difference across the restriction 23 may be detected.

Furthermore, while the three-position valve 21 is used in the above-mentioned embodiment, for example, it is also possible to combine a plurality of two-position valves and to make them perform a switching operation corresponding to the above-mentioned first position to third position.

What is claimed is:

1. A fuel vapor treatment system for an internal combustion engine, comprising:

a canister that is connected to a fuel tank through a vapor introduction passage and has an adsorbent for temporarily adsorbing fuel vapor, the fuel vapor being produced in the fuel tank and being introduced into the canister through the fuel vapor introduction passage;

a concentration measuring means that measures a fuel vapor concentration in an air-fuel mixture when the fuel vapor is desorbed from the adsorbent; and a flow rate control means that is provided in a purge passage and controls a flow rate of the air-fuel mixture containing the fuel vapor purged into the intake pipe on the basis of the fuel vapor concentration, the purge passage connecting the canister and an intake pipe of the internal combustion engine, wherein the concentration measuring means includes:

a measurement passage provided with a restriction;

a gas flow producing means for producing a gas flow in the measurement passage;

a pressure measuring means for measuring pressure produced by the restriction when the gas flow producing means produces the gas flow;

a measurement passage switching means for switching the measurement passage between a first measuring state in which the measurement passage is opened to the atmosphere so that air flows through the measurement passage, and a second measuring state in which the measurement passage communicates with the canister so that the air-fuel mixture containing the fuel vapor flows through the measurement passage;

a fuel vapor concentration computing means for computing concentration of the fuel vapor on the basis of a first pressure measured by the pressure measuring means in the first measuring state and a second pressure measured by the pressure measuring means in the second measuring state; and a malfunction determining means that compares a behavior of change in the first pressure with a behavior of change in the second pressure, and determines that the measurement passage switching means has a malfunction when the behaviors of change in the first and second pressures are substantially identical to each other.

2. The fuel vapor treatment system for an internal combustion engine according to claim 1, wherein the malfunction determining means determines whether the behaviors of change in the first and second pressures are substantially identical to each other with reference to the behavior of change in the first pressure, and determines whether the measurement passage switching means is incapable of switching from the first measuring state to the second measuring state.

3. The fuel vapor treatment system for an internal combustion engine according to claim 2, wherein the pressure measuring means measures pressure downstream of the restriction, the concentration measuring means first measures the first pressure and then measures the second pressure, and the malfunction determining means determines a pressure determination value larger than a convergence value of the first pressure, and determines that the behavior of change in the second pressure is substantially identical to the behavior of change in the first pressure when the second pressure becomes lower than the pressure determination value within a specified period of time after starting to measure the second pressure.

4. The fuel vapor treatment system for an internal combustion engine according to claim 1, wherein the flow rate control means stops a control of flow rate of air-fuel mixture on the basis of the fuel vapor concentration measured by the concentration measuring means when the malfunction determining means determines that the measurement passage switching means has a malfunction.

5. A fuel vapor treatment system for an internal combustion engine, comprising:

a canister that is connected to a fuel tank through a vapor introduction passage and has an adsorbent for temporarily adsorbing fuel vapor, the fuel vapor being produced in the fuel tank and being introduced into the canister through the fuel vapor introduction passage;

a concentration measuring device that measures a fuel vapor concentration in an air-fuel mixture when the fuel vapor is desorbed from the adsorbent; and a flow rate controller that is provided in a purge passage and controls a flow rate of the air-fuel mixture containing the fuel vapor purged into the intake pipe on the basis of the fuel vapor concentration, the purge passage connecting the canister and an intake pipe of the internal combustion engine, wherein the concentration measuring device includes:

a measurement passage provided with a restriction;

a gas flow producer producing a gas flow in the measurement passage;

a pressure measuring device measuring pressure produced by the restriction when the gas flow producer produces the gas flow;

a measurement passage switch switching the measurement passage between a first measuring state in which the measurement passage is opened to the atmosphere so that air flows through the measurement passage, and a second measuring state in which the measurement passage communicates with the canister so that the air-fuel mixture containing the fuel vapor flows through the measurement passage;

a fuel vapor concentration computer computing concentration of the fuel vapor on the basis of a first pressure measured by the pressure measuring device in the first measuring state and a second pressure measured by the pressure measuring device in the second measuring state; and a malfunction determiner comparing a behavior of change in the first pressure with a behavior of change in the second pressure, and determining that the measurement passage switch has a malfunction when the behaviors of change in the first and second pressures are substantially identical to each other.

* * * * *